US009456278B2

(12) United States Patent
Tanaka et al.

(10) Patent No.: US 9,456,278 B2
(45) Date of Patent: Sep. 27, 2016

(54) SPEAKER DEVICE

(75) Inventors: Kazunori Tanaka, Hamamatsu (JP); Susumu Takumai, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 236 days.

(21) Appl. No.: 13/231,007

(22) Filed: Sep. 13, 2011

(65) Prior Publication Data

US 2012/0063618 A1 Mar. 15, 2012

(30) Foreign Application Priority Data

Sep. 14, 2010 (JP) ..... 2010-205418

(51) Int. Cl.
*H04R 5/02* (2006.01)
*H04R 3/12* (2006.01)
*H04R 1/40* (2006.01)

(52) U.S. Cl.
CPC ..... *H04R 3/12* (2013.01); *H04R 1/403* (2013.01); *H04R 2203/12* (2013.01)

(58) Field of Classification Search
CPC ..... H04R 2201/40; H04R 2201/401; H04R 2201/403; H04R 2201/405; H04R 2203/12; H04R 2430/20; H04R 2430/23; H04R 5/02; H04R 29/002
USPC ..... 381/300, 303
See application file for complete search history.

(56) References Cited

U.S. PATENT DOCUMENTS 7,889,878 B2 * 2/2011 Takumai ..... 381/303
2004/0062401 A1 * 4/2004 Davis ..... 381/1
2006/0153407 A1 * 7/2006 Keele et al. ..... 381/182
2006/0291669 A1 * 12/2006 Aylward et al. ..... 381/98
2007/0217621 A1 9/2007 Takumai
2007/0230724 A1 10/2007 Konagai et al.
2008/0037814 A1 * 2/2008 Shau ..... 381/337
2008/0181416 A1 7/2008 Jung (Continued)

FOREIGN PATENT DOCUMENTS

EP 1971187 A2 9/2008
JP 2006025153 A 1/2006

(Continued)

OTHER PUBLICATIONS

Notification of Reasons for Refusal for corresponding JP2010-205418, mail date Jun. 3, 2014. English translation provided.

(Continued)

*Primary Examiner* — Duc Nguyen
*Assistant Examiner* — Taunya McCarty
(74) *Attorney, Agent, or Firm* — Rossi, Kimms & McDowell LLP

(57) ABSTRACT

A speaker device includes a signal processing section and a speaker array that includes a first speaker units group and a second speaker units group. The signal processing section performs a first signal process in which sound based on an audio signal of a first channel is set to output from the first speaker units group and a first virtual focus of the sound is set to an opposite side of the speaker array opposite to a sound output direction of the first speaker units group, and sound based on an audio signal of a second channel is set to output from the second speaker units group and a second virtual focus of the sound based on the audio signal of the second channel is set to an opposite side of the speaker array opposite to a sound output direction of the second speaker units group.

15 Claims, 12 Drawing Sheets

(56) References Cited

U.S. PATENT DOCUMENTS

| | | | | |
|---|---|---|---|---|
| 2008/0226084 | A1* | 9/2008 | Konagai et al. | 381/17 |
| 2009/0010455 | A1* | 1/2009 | Suzuki | H04R 1/403 381/97 |
| 2009/0060236 | A1* | 3/2009 | Johnston et al. | 381/304 |
| 2009/0087000 | A1* | 4/2009 | Ko | H04R 1/403 381/182 |
| 2010/0296678 | A1* | 11/2010 | Kuhn-Rahloff et al. | 381/303 |
| 2013/0121515 | A1* | 5/2013 | Hooley et al. | 381/307 |

FOREIGN PATENT DOCUMENTS

| | | | |
|---|---|---|---|
| JP | 2006-67218 | A | 3/2006 |
| JP | 2008-227803 | A | 9/2008 |

OTHER PUBLICATIONS

Extended European Search Report issued in EP11007498.6, mailed Feb. 5, 2015.

* cited by examiner

SPEAKER DEVICE

BACKGROUND

The present invention relates to a technology using a speaker array.

A speaker device having a speaker array on which a plurality of speaker units are arranged, outputs an audio signal with directivity given thereto. This speaker device generates sound with directivity, directs the focus of the sound in a direction of a wall surface, and causes the sound to reach a listener using the wall surface reflection to give the listener a surround sound sensation (for example, JP-A-2006-25153).

If a surround effect is realized by the technology described in JP-A-2006-25153, the listener senses sounds that reach in a variety of directions such as left, right, rearward, and the like, even though the speaker device exists only in front of the listener. Accordingly, the listener can enjoy movies with realistic sensation. On the other hand, a place in which the surround effect can be obtained is limited to a predetermined range since a wall reflection is used therein, and if the listener moves out of the predetermined range, the surround sensation disappears. In viewing an ordinary television program rather than a movie, the listener may watch television while taking another action. In this case, if the listener moves out of the range in which the surround effect is obtained, the stereo sound sensation may disappear and the listener may experience a sense of incongruity due to the change in the sound quality.

In the case where the television program corresponds to a stereo (2-channel) broadcast, the speaker device may direct the focus of the sound in the direction of the listener without using the wall surface reflection so that left channel (Lch) sound reaches the left ear of the listener and right channel (Rch) sound reaches the right ear of the listener. In this case, however, the listening area of the listener becomes narrow. Accordingly, due to a slight movement of the listener, the stereo sound sensation may not be obtained, and the listener may experience a sense of incongruity due to the change of the sound quality. Also, since Lch sound and Rch sound are output from all the speaker units, the listener may experience a low sense of separation of sound images for the respective channels, and thus no great stereo sound sensation may be obtained.

On the other hand, a speaker device that can give directivity to sound also can output sound so as to be spread out to the front of the speaker device (the listener side as seen from the speaker device). In this case, if a virtual focus that is a virtual output position of the sound (hereinafter referred to as a "virtual focus") is positioned on the rear side of the speaker device, the sound output range widens toward the listener side (see FIG. 5). On the other hand, as described above, since the Lch sound and the Rch sound are output from all speaker units, the sense of separation of sound images for the respective channels becomes low. Also, the Rch sound is output so as to be spread out mainly to the left side of the listener and the Lch sound is output so as to be spread out entirely to the right side of the listener, and for example, if the listener moves to the left side (the left side as seen from the listener who faces the speaker device as shown in FIG. 5B), in spite of the fact that the listener moved to the left side, the listener may hear the Rch sound louder than the Lch sound, and may experience a sense of incongruity with respect to the left/right volume balance.

SUMMARY

The present invention has been made in consideration of the above-described circumstances, and an object of the present invention is to widen the range in which stereo sound sensation is obtained as making the difference between the left and right volume balances due to the difference between listening positions close to a general stereo sound sensation in a speaker device that can give directivity to the sound using a speaker array.

In order to achieve the above object, according to the present invention, there is provided a speaker device comprising:

a signal processing section that performs a signal process with respect to audio signals of a plurality of channels; and a speaker array that includes a first speaker units group having a plurality of speaker units and a second speaker units group having a plurality of speaker units for outputting sounds according to the audio signals of the plurality of channels, the first speaker units group being different from the first speaker units group, wherein the signal processing section performs a first signal process in which sound based on an audio signal of a first channel is set so as to be output from the first speaker units group and a first virtual focus that is a virtual output position of the sound based on the audio signal of the first channel is set to an opposite side of the speaker array opposite to a sound output direction of the first speaker units group with respect to the speaker array, and sound based on an audio signal of a second channel different from the first channel is set so as to be output from the second speaker units group and a second virtual focus that is a virtual output position of the sound based on the audio signal of the second channel is set to an opposite side of the speaker array opposite to a sound output direction of the second speaker units group with respect to the speaker array.

Preferably, the plurality of speaker units of the first and second speaker units groups are arranged on a front face of a housing.

Preferably, the signal processing section performs a second signal process in which a directivity is applied to the sound output from all of the first speaker units group and the second speaker units group of the speaker array.

Preferably, the first speaker units group includes the speaker unit which is closest to one end side in an arrangement direction of the speaker array among the plurality of speaker units of the first and second speaker units groups, and the second speaker units group includes the speaker unit which is closest to the other end side in the arrangement direction of the speaker array.

Preferably, in the first signal process, the first virtual focus is set to the opposite side of the speaker array which is separated in a normal direction normal to an arrangement direction of the speaker array from a center portion of the first speaker units group, and the second virtual focus is set to the opposite side of the speaker array which is separated in the normal direction from a center portion of the second speaker units group.

Preferably, in the first signal process, the first virtual focus is set to a position which is shifted in an arrangement direction of the speaker array from the opposite side of the speaker array which is separated in a normal direction normal to the arrangement direction of the speaker array from a center portion of the first speaker units group, and the second virtual focus is set to a position which is shifted in the arrangement direction of the speaker array from the opposite side of the speaker array which is separated in the normal direction from a center portion of the second speaker units group.

Preferably, in the first signal process, a distance between the first virtual focus and the second virtual focus is substantially same as a distance between the center portion of the first speaker units group and the center portion of the second speaker units group.

Preferably, in the first signal process, a distance between the first virtual focus and the second virtual focus is greater than a distance between the center portion of the first speaker units group and the center portion of the second speaker units group, and the first virtual focus and the second virtual focus are shifted outwardly in the arrangement direction of the speaker array with respect to the center portions of the first and second speaker units groups.

Preferably, in the first signal process, a distance between the first virtual focus and the second virtual focus is smaller than a distance between the center portion of the first speaker units group and the center portion of the second speaker units group, and the first virtual focus and the second virtual focus are shifted inwardly in the arrangement direction of the speaker array with respect to the center portions of the first and second speaker units groups.

Preferably, the first speaker units group and the second speaker units group have no common speaker unit to be commonly used.

Preferably, the signal processing section performs the first signal process when audio signals of two channels are supplied and performs the second signal process when audio signals of more than two channels are supplied.

Preferably, the signal processing section performs the first signal process and the second signal process at the same time when the audio signals of more than three channels are supplied.

Preferably, the first speaker units group and the second speaker units group have a common speaker unit to be commonly used.

Preferably, the speaker array includes a speaker unit other than the plurality of speaker units of the first and second speaker units groups which is not used for outputting the sounds according to the audio signals of the plurality of channels.

Preferably, the speaker array includes a third speaker units group having a plurality of speaker units other than the plurality of speaker units of the first and second speaker units groups, and in the first signal process, sound based on an audio signal of a third channel different from the first and second channels is set so as to be output from the third speaker units group and a third virtual focus that is a virtual output position of the sound based on the audio signal of the third channel is set to an opposite side of the speaker array opposite to a sound output direction of the third speaker units group with respect to the speaker array.

Preferably, the signal processing section reduces the number of channels by a mixing process when the audio signals of the plurality of channels are supplied.

Preferably, the plurality of speaker units of the speaker array are arranged in rows.

Preferably, the plurality of speaker units of each of the first speaker units and the second speaker units of the speaker array are arranged so as to form a polygonal shape region in view from a sound output direction of the speaker array.

Preferably, the plurality of speaker units of each of the first speaker units and the second speaker units of the speaker array are arranged so as to form a circular shape region in view from a sound output direction of the speaker array.

According to the present invention, the range in which a stereo sound sensation is obtained can be widened as making the difference between the left and right volume balances due to the difference between listening positions close to a general stereo sound sensation in the speaker device that can give directivity using the speaker array.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

<Embodiment>

[Entire Construction]

Figure 1:
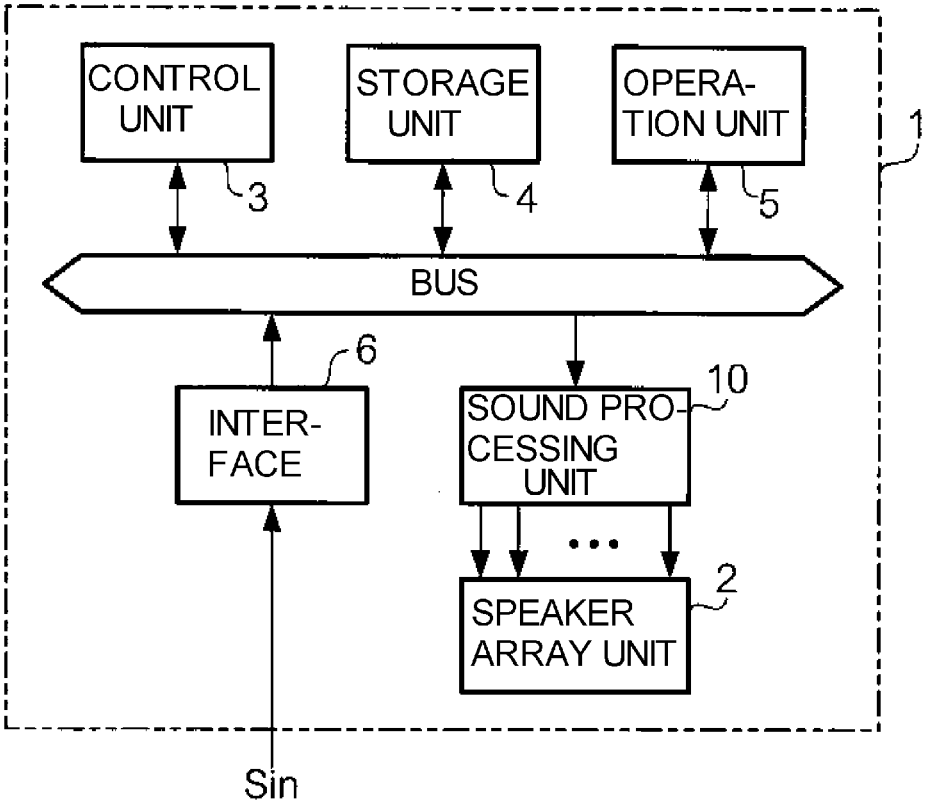
FIG. 1 is a block diagram illustrating a configuration of a speaker device according to an embodiment of the invention.

FIG. 1 is a block diagram illustrating a configuration of a speaker device 1 according to an embodiment of the invention. The speaker device 1 includes a control unit 3, a storage unit 4, an operation unit 5, an interface 6, and a sound processing unit 10. The respective units are connected through a bus. Also, the speaker device 1 includes a speaker array unit 2 having a plurality of speaker units connected to the sound processing unit 10. In the speaker device 1, the sound processing unit 10 performs signal processing with respect to audio data, and the speaker array unit 2 outputs sound with directivity given thereto. As the sound processing unit 10 performs signal processing with respect to the audio data, the speaker device 1 sets a virtual focus in the rear side of the speaker array unit 2, and outputs the sound that is radially spread out to the front of the speaker array unit 2. In the following description, the sound to which the directivity is given among sounds output from the speaker array unit 20 is called as a sound beam (beam shaped sound), and sound that is radially spread out is called as a radiated sound.

The control unit 3 includes a CPU (Central Processing Unit), a RAM (Random Access Memory), a ROM (Read Only Memory), and the like. The control unit 3 controls respective units of the speaker device 1 through the bus by executing a control program stored in the storage unit 4 or the ROM. The control unit 3, for example, also functions as a control section for performing control of parameter setting in the respective processes that are performed by the sound processing unit 10 through control of the sound processing unit 10.

The storage unit 4 is a nonvolatile memory or the like, and stores set parameters and the like, that are used when the control unit 3 performs a control operation. The set parameters include parameters set by the sound processing unit 10 according to the position of the virtual focuses of the radiated sound. Also, the set parameters include parameters set by the sound processing unit 10 according to the direction in which the sound beam is output.

Also, the storage unit 4 stores beam information on the time until the sound beam output from the speaker device 1 is reflected by a wall surface of a room in which the speaker device 1 is installed and then reaches a sound reception point at which a listener is located, the output direction of the sound beam for enabling the sound beam to reach the sound reception point, the time until the sound beam from the speaker device 1 directly reaches the sound reception point, the output direction of the sound beam at that time, and the like. This beam information is calculated from the result of measuring the sound beam, which is output from the speaker device 1 installed in the room and is input to a microphone installed in advance at the sound reception point, as changing the output direction. This measurement, for example, is performed when the environments, such as the installation position of the speaker device 1, an installation room, the sound reception point, and the like, are changed, and is initiated by a user's operation of the operation unit 5.

The operation unit 5 has operation buttons and so on for inputting volumes for controlling sound levels and instructions for performing setting changes, and outputs information that indicates the contents of an operation to the control unit 3.

The interface 6 is an input terminal or the like for acquiring audio data Sin from outside.

Next, a speaker array unit 2 having a plurality of speaker units will be described using FIG. 2.

[Speaker Unit Arrangement]

Figure 2:
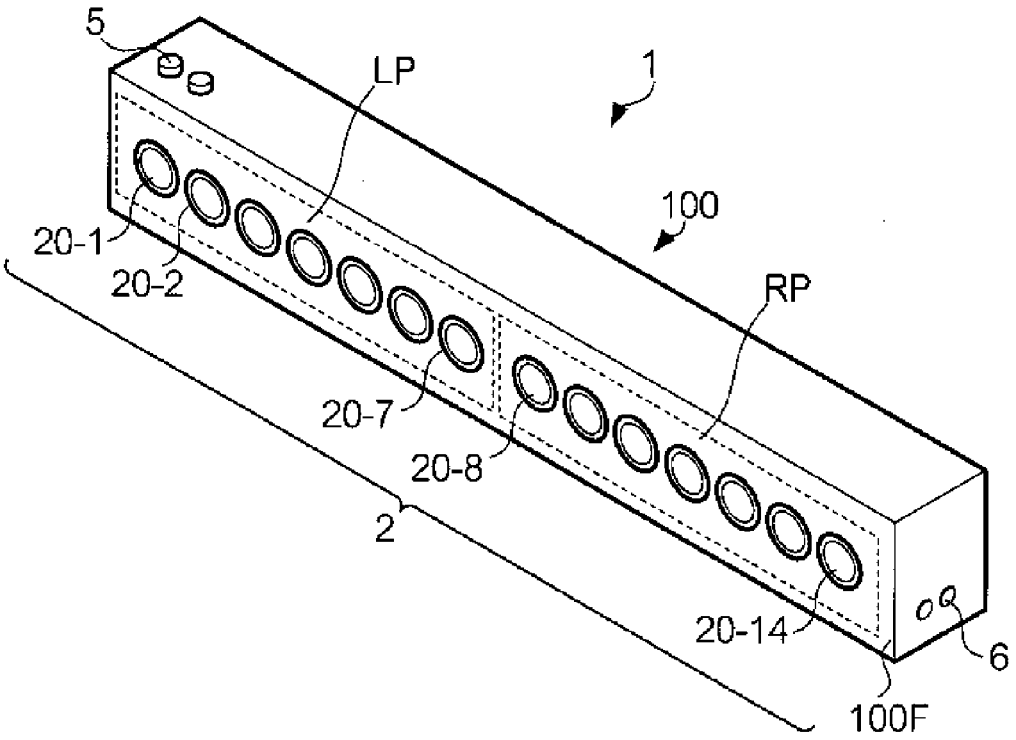
FIG. 2 is a view illustrating an external appearance of the speaker device according to the embodiment of the invention.

FIG. 2 is a view illustrating an external appearance of the speaker device 1 according to the embodiment of the invention. In this example, the speaker device 1 has a substantially rectangular cuboid housing 100. As illustrated in FIG. 2, in the speaker device 1, a plurality of speaker units 20-1, 20-2, . . . , and 20-14 that constitute a speaker array unit 2 are substantially non-directional speaker units, and are installed in a line along a longitudinal direction (in a horizontal surface) of the housing 100 on a front face 100F of the housing 100 of the speaker device 1. The front face 100F means a face that is located on the front side of the speaker device 1 that is a direction in which a listener is mainly located, as seen from the speaker device 1, among faces that constitute the housing 100.

The speaker array unit 2 can output a sound beam toward a specified direction that is included in a horizontal surface through outputting of sound from the speaker units 20-1, 20-2, . . . , and 20-14. The speaker array unit 2 may output a sound beam in which a sound focus is set in the front and a horizontal surface of the speaker array unit 2 or may output a sound beam in which a sound focus is not set so that the sound beam becomes a parallel sound beam within the horizontal surface. Also, the speaker array unit 2 may output radiated sound in which a virtual focus is set in the rear of the speaker array unit 2 within the horizontal surface. Now, the configuration of the sound processing unit 10 will be described using FIG. 3.

[Configuration of Sound Processing Unit 10]

Figure 3:
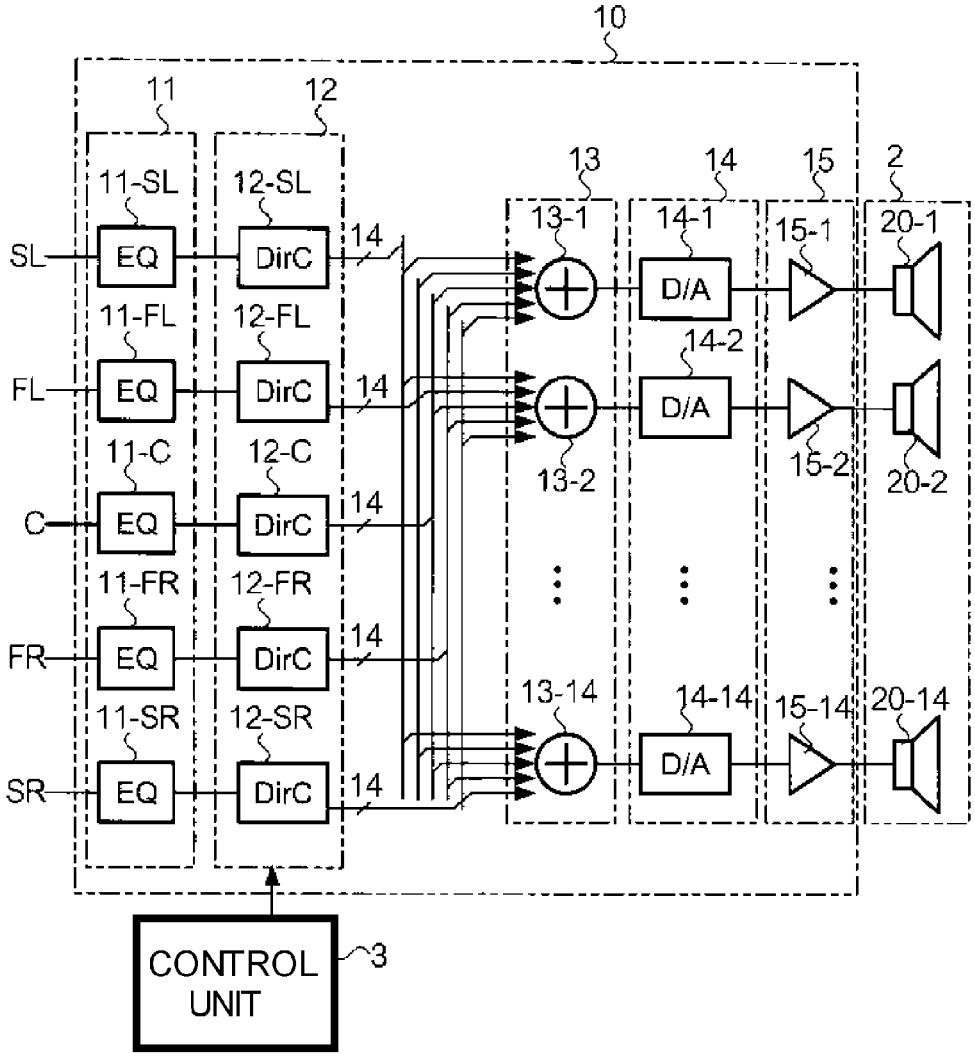
FIG. 3 is a diagram illustrating a configuration of a sound processing unit according to the embodiment of the invention.

FIG. 3 is a diagram illustrating the configuration of the sound processing unit 10 according to the embodiment of the invention. The sound processing unit 10 includes an equalizer (EQ) unit 11, a signal processing unit (DirC) 12, an addition unit 13, a D/A unit 14, and an amplifying unit 15. The equalizer unit 11 and the signal processing unit 12 are installed according to the maximum number of channels that is included in audio data Sin input from the interface 6, and in this example, the sound processing unit 10 is configured to correspond to five channels (5ch) including a C (Center) ch, an FL (Front Left) ch, an FR (Front Right) ch, an SL (Surround L) ch, and SR (Surround R) ch. In this case, although it is possible to set the maximum number of channels to 5.1ch including a channel output from a subwoofer or the like, the maximum number of channels is set to 5ch in this example.

Hereinafter, the audio data that corresponds to the FL ch in the audio data Sin will be described as the audio data FL. Also, the equalizer unit, for example, that corresponds to the FL ch in the equalizer unit 11 will be described as the equalizer unit 11-FL.

The equalizer unit 11 includes equalizer units 11-C, 11-FL, 11-FR, 11-SL, and 11-SR. The equalizer unit 11 outputs the input audio data with the frequency characteristic preset by the control unit 3 with respect to the input audio data.

In this example, the audio data Sin input to the interface 6 may be composed of 5ch as described above, or stereo 2ch (Lch and Rch).

In the case where the audio data Sin input from the interface 6 is 5ch, the audio data C, FL, FR, SL, and SR is input to respective corresponding equalizer units 11-C, 11-FL, 11-FR, 11-SL, and 11-SR under the control of the control unit 3.

Also, in the case where the audio data Sin input from the interface 6 is 2ch, the audio data L is input to the equalizer unit 11-FL and the audio data R is input to the equalizer unit 11-FR under the control of the control unit 3. The audio data is not input to other equalizer units 11-C, 11-SL, and 11-SR.

The signal processing unit 12 includes signal processing units 12-C, 12-FL, 12-FR, 12-SL, and 12-SR. The signal processing units 12-C, 12-FL, 12-FR, 12-SL, and 12-SR receive audio data from the corresponding equalizer units 11-C, 11-FL, 11-FR, 11-SL, and 11-SR. The signal processing units 12-C, 12-FL, 12-FR, 12-SL, and 12-SR generate audio data to be supplied to the corresponding speaker units 20-1, 20-2, . . . , and 20-14 by executing signal process such as delay, level control, and the like, with respect to the respectively input data, under the control of the control unit 3, and supply the generated audio data to signal lines to which the corresponding speaker units 20-1, 20-2, . . . , and 20-14 are connected.

The contents of the signal processing include a first signal process for enabling the speaker array unit 2 to output the radiated sound and a second signal process for enabling the speaker array unit 2 to output the sound beam. In this example, if the number of channels of the audio date Sin input to the interface 6 is 2ch, the signal processing unit 12 performs the first signal process under the control of the control unit 3, and if the number of channels is 5ch, the signal processing unit 12 performs the second signal processing under the control of the control unit 3.

Since the first signal process is a process that is used when the number of channels of the audio data Sin is 2ch, the signal processing units 12-FL and 12-FR are used, and other signal processing units 12-C, 12-SL, and 12-SR are not used since an input of the audio data is not performed.

The signal processing unit 12-FL generates the audio data corresponding to the plurality of speaker units 20-8, 20-9, . . . , and 20-14 installed in an area that is a portion of the front face 100F (hereinafter, also referred to as Lch front surface area LP (see FIGS. 2 and 4)) by performing the signal process with respect to the audio data L input from the equalizer unit 11-FL. The signal processing unit 12-FL sets the signal processing parameters so that the radiated sound is output by the sound output from the speaker units 20-8, 20-9, . . . , and 20-14, and the virtual focus of the radiated sound (hereinafter, referred to as "Lch virtual focus LG (see FIGS. 4A and 4B)) is located on the rear side of the housing 100 rather than the Lch front surface area LP.

The signal processing unit 12-FR generates the audio data corresponding to the plurality of speaker units 20-1, 20-2, . . . , and 20-7 installed in an area that is a portion of the front face 100F (hereinafter, also referred to as Rch front surface area RP (see FIGS. 2, 4A and 4B)) by performing the signal process with respect to the audio data R input from the equalizer unit 11-FR. The signal processing unit 12-FR sets the signal processing parameters so that the radiated sound is output based on the sound output from the speaker units 20-1, 20-2, . . . , and 20-7, and the virtual focus of the radiated sound (hereinafter, referred to as "Rch virtual focus RG (see FIGS. 4A and 4B)) is located on the rear side of the housing 100 rather than the Rch front surface area RP.

These parameters are determined by the control unit 3 with reference to the parameters stored in the storage unit 4.

The second signal process is a signal process using the signal processing units 12-C, 12-FL, 12-FR, 12-SL, and 12-SR.

The signal processing unit 12-FL generates the audio data corresponding to the speaker units 20-1, 20-2, . . . , and 20-14 installed in an area that includes Lch front surface area LP and Rch front surface area RP, that is, the front face 100F by performing the signal process with respect to the audio data FL input from the equalizer unit 11-FL. The signal processing unit 12-FL sets the signal processing parameters so that the sound beam is output based on the sound output from the speaker units 20-1, 20-2, . . . , and 20-14. The direction of the sound beam is determined according to the beam information stored in the storage unit 4. In this example, the direction of the sound beam is determined so that the sound beam is reflected by the wall surface on the left side of the listener and then reaches the listener.

In the same manner as the signal processing unit 12-FL, other signal processing units 12-C, 12-FR, 12-SL, and 12-SR generate the audio data corresponding to the speaker units 20-1, 20-2, . . . , and 20-14 by performing the signal process with respect to the audio data input from the equalizer unit 11. Also, the direction of the sound beam that is output from the speaker units 20-1, 20-2, . . . , and 20-14 in correspondence with the respective channels is determined according to the beam information stored in the storage unit 4.

The parameters set in the signal processing units 12-C, 12-FL, 12-FR, 12-SL, and 12-SR are determined by the control unit 3 with reference to the parameters stored in the storage unit 4.

The addition unit 13 includes addition units 13-1, 13-2, . . . , and 13-14. The addition unit 13-1 adds audio signals supplied from the directivity control units 12-SL, 12-FL, 12-C, 12-FR, and 12-SR to signal lines corresponding to the speaker unit 20-1. In the same manner, the addition units 13-2, 13-3, . . . , and 13-14 add audio data supplied to signal lines corresponding to the speaker units 20-2, 20-3, . . . , and 20-14, respectively.

The D/A unit 14 includes D/A units 14-1, 14-2, . . . , and 14-14. The D/A units 14-1, 14-2, . . . , and 14-14 converts the audio data added by the addition units 13-1, 13-2, . . . , and 13-14 into analog signals, and output the audio signals obtained through conversion.

The amplifying unit 15 includes amplifying units 15-1, 15-2, . . . , and 15-14. The amplifying units 15-1, 15-2, . . . , and 15-14 amplify the audio signals output from the DA units 14-1, 14-2, . . . , and 14-14, and output the amplified audio signal to the speaker units 20-1, 20-2, . . . , and 20-14 to output sound. As described above, the sound output from the speaker array unit 2 is output as the radiated sound in the case where the first signal process is performed in the signal processing unit 12, and is output as the sound beam in the case where the second signal process is performed. The configuration of the sound processing unit 10 has been described as above.

Hereafter, the radiated sound that is output in the case where the first signal process is performed in the signal processing unit 12 will be described using FIGS. 4A and 4B.

[Range of Radiated Sound]

Figure 4A:
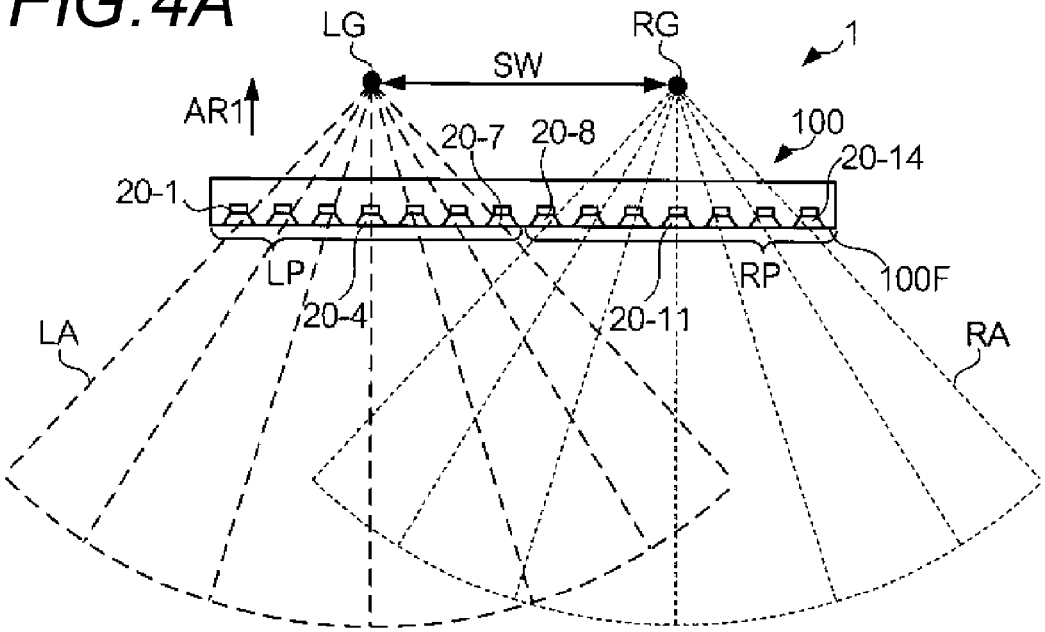
FIGS. 4A and 4B are diagrams illustrating a reaching range of radiated sound according to the embodiment of the invention.
Figure 4B:
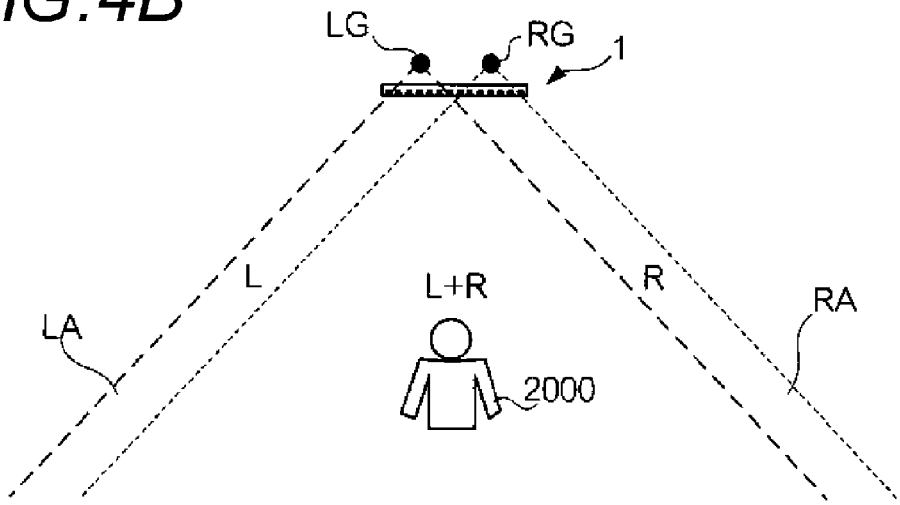

FIGS. 4A and 4B are diagrams illustrating reaching ranges of radiated sounds according to the embodiment of the invention. As illustrated in FIG. 4A, the sound based on the audio data L is output as the radiated sound from the speaker units 20-1, 20-2, . . . , and 20-7. The Lch virtual focus LG of this radiated sound is set on the rear side (direction indicated by the arrow AR1) of the housing 100 in the center portion of the Lch front surface area LP that is a portion of the front face 100F. The center portion of the Lch front surface area LP is substantially the center portion in the direction in which the speaker units are arranged in the Lch front surface area LP, and in this example, the center portion becomes the portion of the speaker unit 20-4 installed in the center. Since the Lch virtual focus LG is set as described above, the radiated sound based on the audio data L is spread out substantially over the Lch radiation area LA.

On the other hand, the sound based on the audio data R is output as the radiated sound from the speaker units 20-8, 20-9, . . . , and 20-14. The Rch virtual focus RG of this radiated sound is set on the rear side (direction indicated by the arrow AR1) of the housing 100 in the center portion of the Rch front surface area RP that is a portion of the front face 100F. The center portion of the Rch front surface area RP is substantially the center portion in the direction in which the speaker units are arranged in the Rch front surface area RP, and in this example, the center portion becomes the portion of the speaker unit 20-11 installed in the center. Since the Rch virtual focus RG is set as described above, the radiated sound based on the audio data R is spread out substantially over the Rch radiation area RA.

Since the Lch virtual focus LG and the Rch virtual focus RG are set to be positioned as described above, the distance SW between the virtual focuses substantially coincides with the distance from the speaker unit 20-4 to the speaker unit 20-11.

FIG. 4B illustrates a range that is wider than the range as illustrated in FIG. 4A with respect to the Lch radiation area LA and Rch radiation area RA. A listener 2000 is located in front of the speaker device 1. The area L+R including the position of the listener 2000 is an area in which the Lch radiation area LA and the Rch radiation RA are overlap to each other, and is an area that can give the listener 2000 the stereo sound sensation. On the other hand, in the case where the listener 2000 moves to the left and gets out of the Rch radiation area RA in a state where the listener 2000 is directed in the direction of the stereo device 1 (hereinafter, the case where the listener moves to the left means that the listener moves to the left in a state that the listener 2000 is directed in the direction of the stereo device 1, and the right side is the same), the listener 2000 hears the Rch sound greatly attenuated and the Lch sound strengthened, and thus may lose the stereo sound sensation. In the case where the listener 2000 moves to the opposite side (right side), the listener 2000 hears the Rch sound strengthened, and thus may lose the stereo sound sensation. That is, the area in which the stereo sound sensation is given to the listener 2000 is the area L+R.

Also, if the listener 2000 moves to a position that is close to the left side area L even within the range of the area L+R, the listener hears the Rch sound that is lower than the Lch sound, while if the listener 2000 moves to a position that is close to the right side area R, the listener hears the Lch sound that is lower than the Rch sound. Since this is the same phenomenon as that in the case of obtaining the stereo sound sensation using the Lch and Rch speakers, the listener 2000 can obtain the stereo sound sensation with low incongruity when the listener 2000 listens to the sound from the speaker device 1 while moving.

In this example, the Lch radiation area LA has a shape that is spread in bilateral symmetry with respect to a line that extends from the Lch virtual focus LG to the normal direction of the front face 100F (front direction of the speaker device 1). This is realized by installing the Lch virtual focus LG in the rear of the center portion of the Lch front surface area LP. The Rch radiation area RA is the same.

Further, the Lch radiation area LA and the Rch radiation area RA are in a symmetric relationship with respect to a line that extends from the center point between the Lch virtual focus LG and the Rch virtual focus RG to the normal direction of the front face 100F. This is realized by making the Lch front surface area LP and the Rch front surface area RP have the same size, or by making the Lch virtual focus LG and the Rch virtual focus RG be in a symmetric relationship with respect to the line that extends from the center point between the center portion of the Lch front surface area LP and the center portion of the Rch front surface area RP to the normal direction of the front face 100F.

In the case where the above-described relationship is set, the listener 2000 can obtain a good stereo sound sensation.

In this case, the distance from the Lch front surface area LP of the Lch virtual focus LG is set according to the width (spreading angle) of the Lch radiation area LA. As the Lch radiation area LA is widened, the distance may become shortened. However, if the distance from the Lch front surface area LP of the Lch virtual focus LG is too short, the sound quality deteriorates, while if the distance is too long, the spreading of the Lch radiation area LA is excessively narrowed. Accordingly, the distance may be controlled within a predetermined range. Because of this, the predetermined range may be determined to be the range that becomes farther from the Lch front surface area LP as the size of the Lch front surface area LP becomes larger. That is, it is sufficient if the spreading angle of the Lch radiation area LA is controlled within the predetermined range. Although the Rch virtual focus RG is in the same manner, the distance from the Lch front surface area LP to the Lch virtual focus LG may not be equal to the distance from the Rch front surface area RP to the Rch virtual focus RG. That is, the above-described symmetric relationship is to obtain a good stereo sound sensation, and thus if the stereo sound sensation with low incongruity is obtained from the configuration, it is not necessary to satisfy the above-described relationship.

[Comparison with a Method in the Related Art]

In the speaker device 1 in the related art, a case where the radiated sound based on the audio data L and the radiated sound based on the audio data R are respectively output using all speaker units 20-1, 20-2, . . . , and 20-14 of the speaker array unit 2 will be described as an example in the related art using FIG. 5.

Figure 5A:
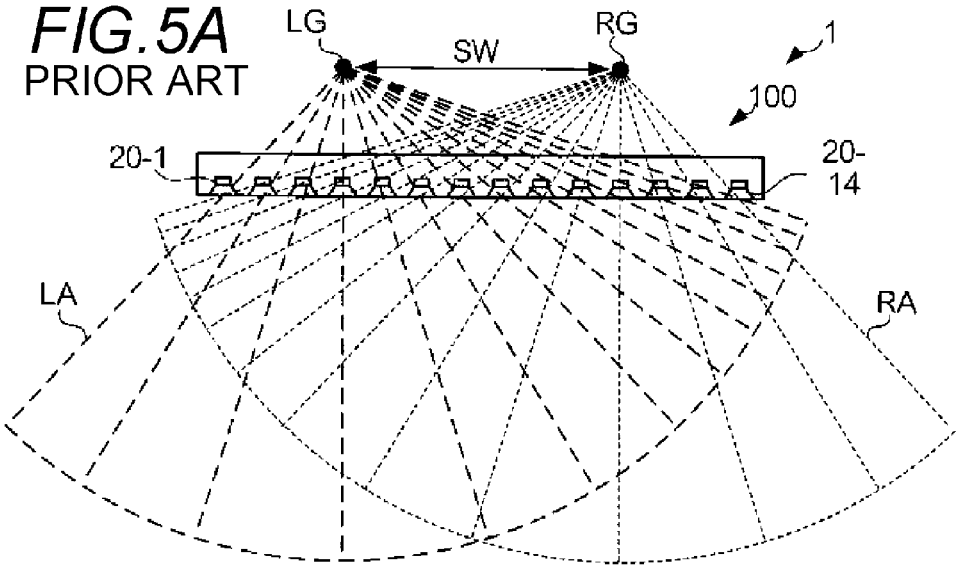
FIG.5A PRIOR ART
FIGS. 5A and 5B are diagrams illustrating a reaching range of radiated sound in the related art.
Figure 5B:
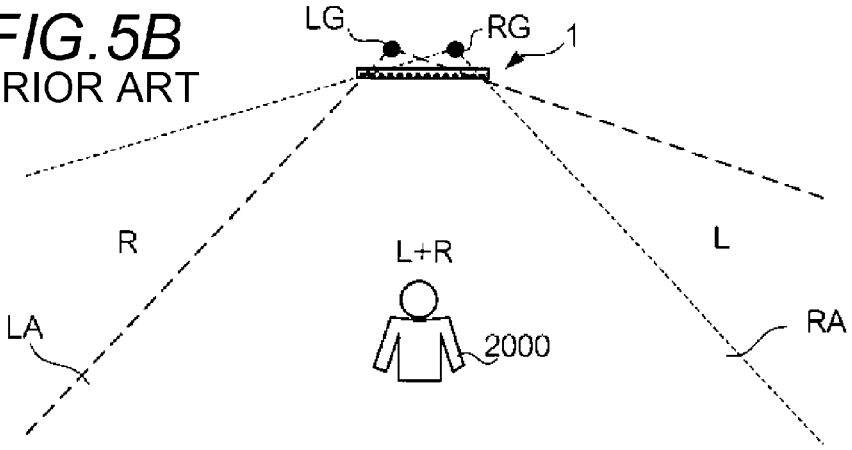
FIG.5B PRIOR ART

FIGS. 5A and 5B are diagrams illustrating a reaching range of radiated sound in the related art. The Lch virtual focus LG, the Rch virtual focus RG, and the distance SW between the virtual focuses LG and RG as illustrated in FIGS. 5A and 5B are the same parameters as those illustrated in FIGS. 4A and 4B. As illustrated in FIG. 5A, the sound based on the audio data L and the sound based on the audio data R are output from all speaker units 20-1, 20-2, . . . , and 20-14. That is, the Lch front surface area LP and the Rch front surface area RP coincide with each other.

Accordingly, the Lch radiation area LA and the Rch radiation area RA have different ranges from those illustrated in FIGS. 4A and 4B. That is, as illustrated in FIG. 5B, the Lch radiation area LA has a range that is spread out to the right side of the listener 2000 in comparison to the case illustrated in FIG. 4A, and the Rch radiation area RA has a range that is spread out to the left side of the listener 2000 in comparison to the case illustrated in FIG. 4A. Accordingly, if the listener 2000 moves to the left side, unlike the case illustrated in FIGS. 4A and 4B, the listener 2000 can hear the Lch sound that is lower than the Rch sound, and if the listener 2000 further moves, the listener 2000 can hear the strong Rch sound. That is, this phenomenon is different from the case where the stereo sound sensation is obtained using Lch and Rch speakers, and if the listener 2000 moves while listening to the sound from the speaker device 1, the listener 2000 may experience the sense of incongruity.

As described above, since the listener 2000 listens to the sound from all speaker units 20-1, 20-2, . . . , and 20-14 that constitute the speaker array unit 2, the listener 2000 may not experience the stereo sound sensation so much and may experience a sense of incongruity due to the different sound strength that the listener 2000 feels in dependence upon the moving direction of the listener 2000.

On the other hand, in the embodiment of the invention as described above, the radiated sound is output by the first signal process with respect to the Lch front surface area LP and the Rch front surface area RP which are different from each other, and thus the listener 2000 can obtain stereo sound sensation with low incongruity even when the listener 2000 moves.

MODIFIED EXAMPLES

As described above, although the embodiment of the invention has been described, the present invention can be embodied in diverse aspects as follows.

Modified Example 1

In the embodiment of the invention as described above, although the Lch virtual focus LG is set on the rear side of the housing 100 in the center portion of the Lch front surface area LP that is a portion of the front face 100F, it may be in a position that gets out of the center portion. The Rch virtual focus RG is the same. In this example, a case where the distance SW between the virtual focuses is shorter than that of the case according to the embodiment of the invention will be described in comparison to the case in the related art using FIG. 6.

Figure 6A:
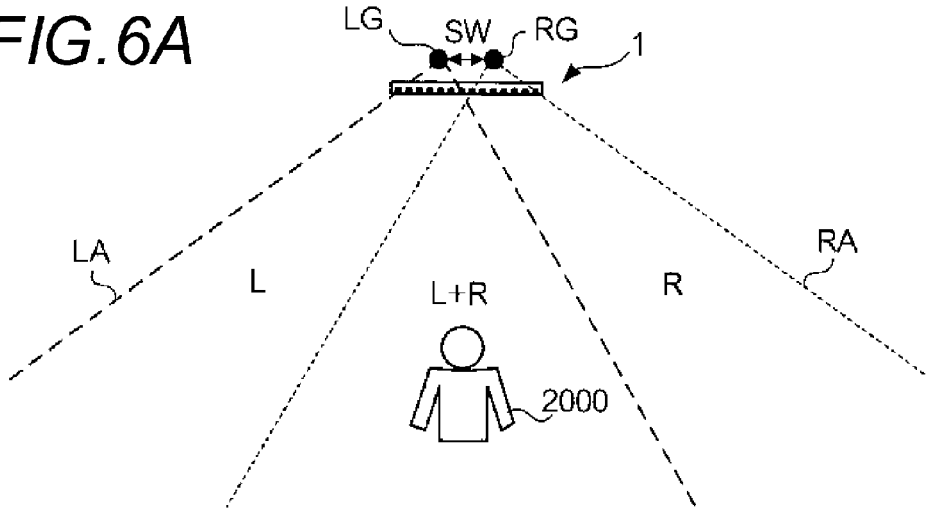
FIGS. 6A and 6B are diagrams illustrating reaching ranges of radiated sound in a modified example 1 of the invention and in the related art.
Figure 6B:
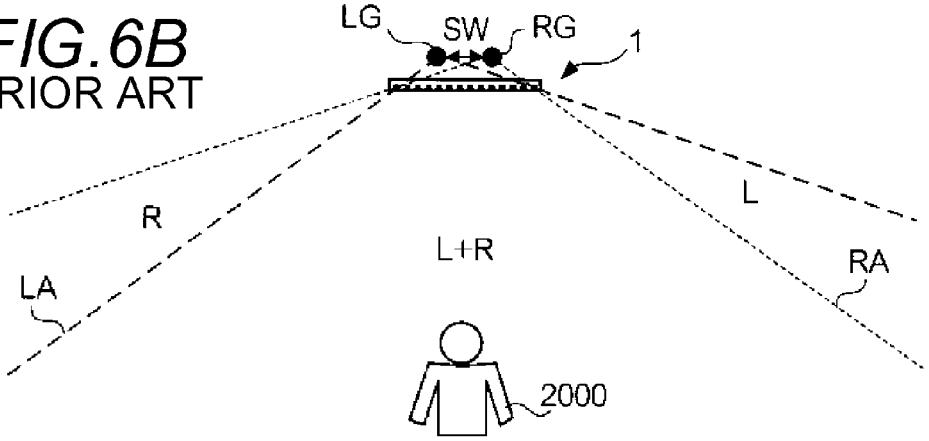
FIG.6B PRIOR ART

FIGS. 6A and 6B are diagrams illustrating reaching ranges of radiated sound in a modified example 1 of the invention and in the related art. FIG. 6A illustrates the reaching range of the radiated sound according to the modified example 1 of the invention, and FIG. 6B illustrates the reaching range of the radiated sound in the related art.

In the case of the modified example 1, the range of the area L+R in which the stereo sound sensation is obtained becomes narrow due to the shortening of the distance SW between the virtual focuses, whereas in the case of the example in the related art, the range of the area L+R becomes wide. On the other hand, as described above, in the modified example 1, the sound based on the audio data L and the sound based on the audio data R are output from the separated areas, whereas in the example in the related art, the corresponding sounds are output from all the speaker units 20-1, 20-2, . . . , and 20-14. Accordingly, in the example in the related art, although the area L+R has been spread out, it becomes more difficult to obtain the stereo sound sensation due to the shortening of the distance SW between the virtual focuses, whereas in the modified example 1, the directivity of the sound based on the audio data L and the sound based on the audio data R is maintained, and thus it is rare to fail to obtain the stereo sound sensation.

Modified Example 2

In addition to the modified example 1, a case where the distance SW between the virtual focuses is longer than that of the case according to the embodiment of the invention shown in FIGS. 4A and 4B will be described in comparison to the case in the related art using FIG. 7.

Figure 7A:
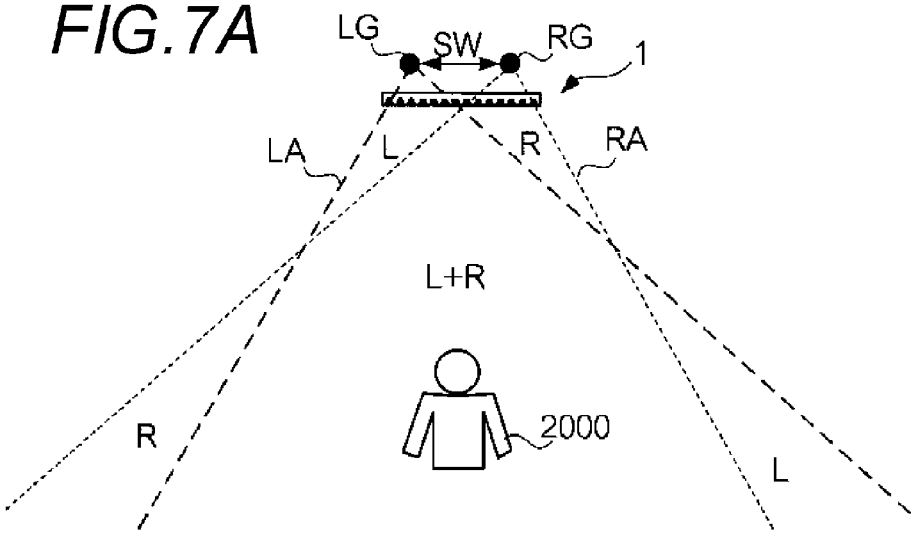
FIGS. 7A and 7B are diagrams illustrating reaching ranges of radiated sound in a modified example 2 of the invention and in the related art.
Figure 7B:
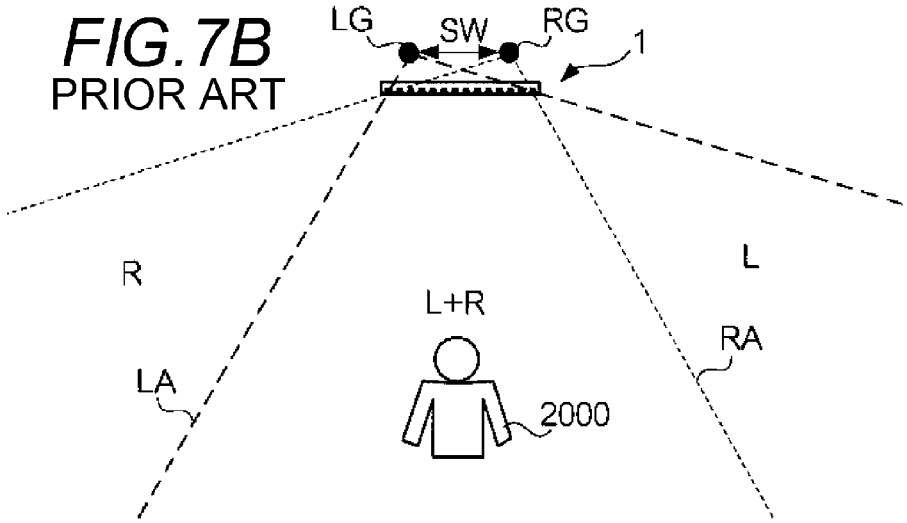
FIG.7B PRIOR ART

FIGS. 7A and 7B are diagrams illustrating reaching ranges of radiated sound in a modified example 2 of the invention and in the related art. FIG. 7A illustrates the reaching range of the radiated sound according to the modified example 2 of the invention, and FIG. 7B illustrates the reaching range of the radiated sound in the related art.

In the case in the related art, the range of the area L and the area R, in which the stereo sound sensation is not obtained, is merely widened due to the widening of the distance SW between the virtual focuses, and there is no factor that improves the stereo sound sensation from the state before the distance SW between the virtual focuses is widened.

In the case of the modified example 2, if the listener 2000 is apart from the speaker device 1, the state where the listener 2000 has moved to the left and to the right becomes close to the case in the related art (for example, the listener 2000 hears the Rch louder regardless of the listener's movement to the left). However, if the listener 2000 is close to the speaker device 1, such a phenomenon does not occur, and the relationship becomes the same as the relationship in the embodiment of the invention. As described above, in the case where the listener 2000 is close to the speaker device 1, the listener 2000 experiences a high sense of separation of sound images due to the widening of the distance SW between the virtual focuses, and thus greater stereo sound sensation can be obtained.

Modified Example 3

In the embodiment of the invention as described above, although the Lch virtual focus LG is set on the rear side of the housing 100 in the center portion of the Lch front surface area LP that is a portion of the front face 100F, it may be also possible to move the Lch virtual focus LG and the Rch virtual focus RG in the same direction. In this case, the distance SW between the virtual focuses may be maintained constant. The control to move the Lch virtual focus LG and the Rch virtual focus RG may be performed according to a listener's instruction input through the operation unit 5.

Hereinafter, the case of moving the Lch virtual focus LG and the Rch virtual focus RG to the left (direction indicated by the arrow AR2) while maintaining the distance SW between the virtual focuses constant will be described in comparison to the case in the related art by using FIGS. 8A and 8B.

Figure 8A:
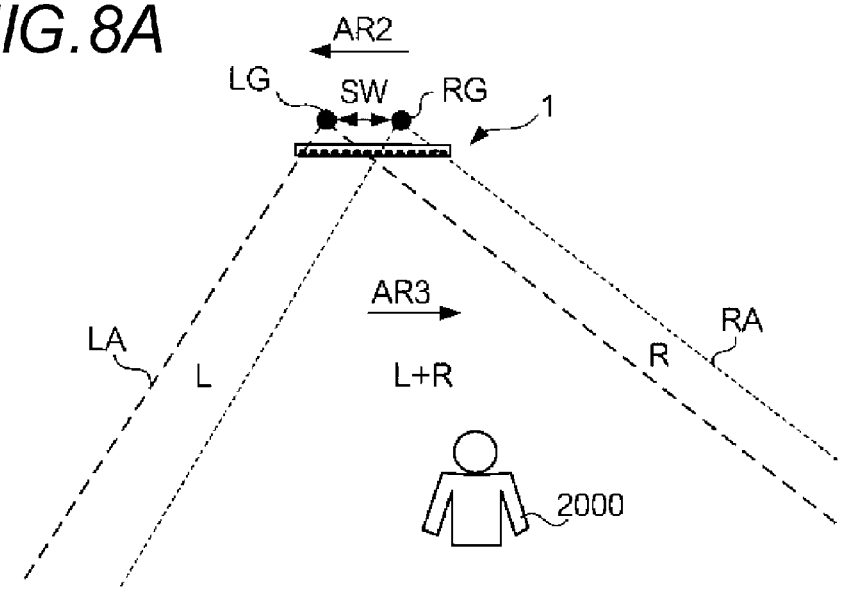
FIGS. 8A and 8B are diagrams illustrating reaching ranges of radiated sound in a modified example 3 of the invention and in the related art.
Figure 8B:
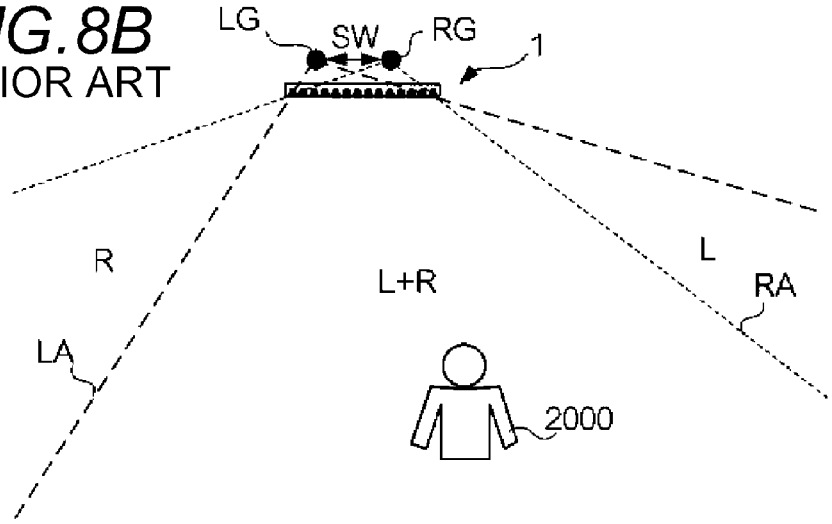
FIG.8B PRIOR ART

FIGS. 8A and 8B are diagrams illustrating reaching ranges of radiated sound in a modified example 3 of the invention and in the related art. In the modified example 3, the area L+R has entirely moved to the right side (direction AR3) in comparison to the case before moving the Lch virtual focus LG and the Rch virtual focus RG, but the relative positional relationship between the area L, the area R, and the area L+R has not been changed. Accordingly, even in the case of the modified example 3, the same effect as that according to the embodiment of the invention is obtained.

Even in the case in the related art, the relative positional relationship between the area L, the area R, and the area L+R is not changed in comparison to the case before moving the Lch virtual focus LG and the Rch virtual focus RG. Accordingly, in the case in the related art, the stereo sound sensation is not improved.

Modified Example 4

In the embodiment of the invention as described above, the Lch front surface area LP and the Rch front surface area RP do not overlap each other. However, portions thereof may overlap each other.

Figure 9:
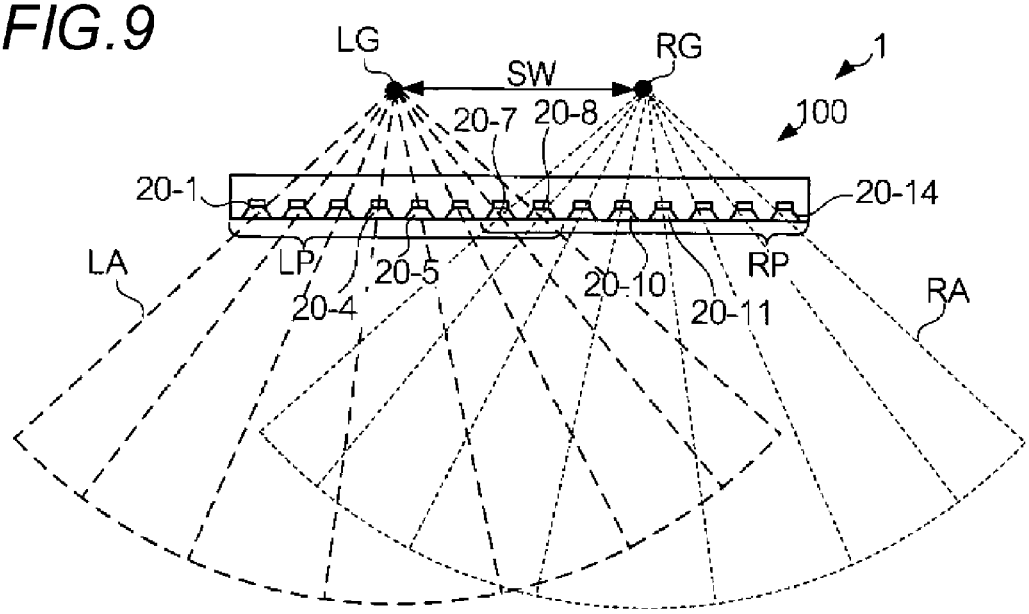
FIG. 9 is a diagram illustrating a reaching range of radiated sound and virtual focus positions according to a modified example 4 of the invention.

FIG. 9 is a diagram illustrating the reaching range of the radiated sound and the virtual focus position according to a modified example 4 of the invention. As illustrated in FIG. 9, in this example, the Lch front surface area LP is prescribed as an area that includes the speaker units 20-1, 20-2, . . . , and 20-8, and the Rch front surface area RP is prescribed as an area that includes the speaker units 20-7, 20-8, . . . , and 20-14. That is, the range in which the speaker units 20-7 and 20-8 are installed corresponds to an overlapping portion.

In this case, the center portion of the Lch front surface area LP substantially becomes the portion between the speaker units 20-4 and 20-5. In order to obtain good stereo sound sensation, it is preferable that the left and right sound output areas are symmetrical as in the embodiment of the invention, and the Lch virtual focus LG is set on the rear side of the housing 100 in this portion. The center portion of the Rch front surface area RP substantially becomes the portion between the speaker units 20-10 and 20-11.

By doing this, the Lch radiation area LA and the Rch radiation area RA are widened in comparison to the case according to the embodiment of the invention, and thus the distance SW between the virtual focuses is shortened.

Modified Example 5

In the embodiment of the invention as described above, speaker units, which are included in neither the Lch front surface area LP nor the Rch front surface area RP, do not exist. However, such speaker units may exist.

Figure 10:
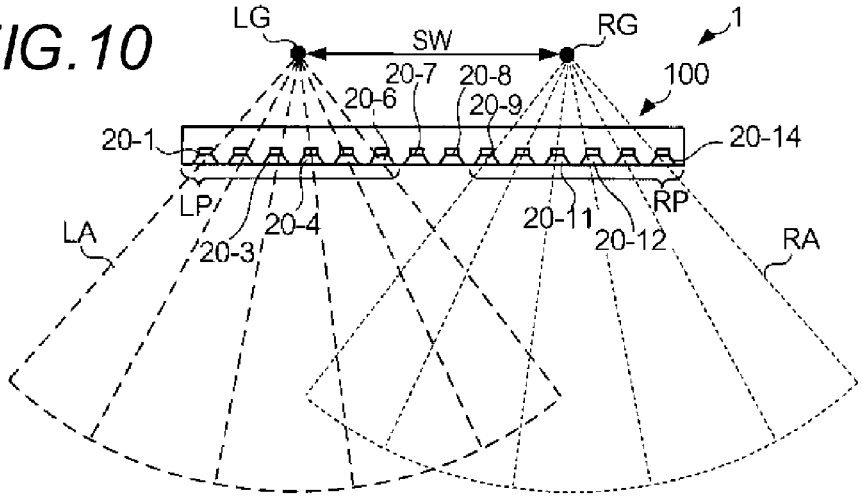
FIG. 10 is a diagram illustrating a reaching range of radiated sound and virtual focus positions according to a modified example 5 of the invention.

FIG. 10 is a diagram illustrating the reaching range of the radiated sound and the virtual focus position according to a modified example 5 of the invention. As illustrated in FIG. 10, in this example, the Lch front surface area LP is prescribed as an area that includes the speaker units 20-1, 20-2, . . . , and 20-6, and the Rch front surface area RP is prescribed as an area that includes the speaker units 20-9, 20-10, . . . , and 20-14. That is, the speaker units 20-7 and 20-8 exist in an area that is not included in the Lch front surface area LP and the Rch front surface area RP, and do not output the sound based on the audio data L and R.

In this case, the center portion of the Lch front surface area LP substantially becomes the portion between the speaker units 20-3 and 20-4. Accordingly, the Lch virtual focus LG is set on the rear side of the housing 100 in this portion. The center portion of the Rch front surface area RP substantially becomes the portion between the speaker units 20-11 and 20-12.

By doing this, the Lch radiation area LA and the Rch radiation area RA are narrowed in comparison to the case according to the embodiment of the invention, and thus the distance SW between the virtual focuses is lengthened.

In this case, the Lch front surface area LP is an area that includes the speaker unit 20-1 that is most closest to one end side in the length direction of the housing 100, and the Rch front surface area RP is an area that includes the speaker unit 20-14 that is most closest to the other end side of the housing 100. However, the areas may not include the above-described speaker units. For example, the Lch front surface area LP may be an area that includes the speaker units 20-2, 20-3, . . . , and 20-7.

As indicated in the embodiment, the modified example 4, and the modified example 5, it is sufficient if the Lch front surface area LP and the Rch front surface area RP include a plurality of speaker units, and correspond to areas that are different from each other.

Modified Example 6

In the embodiment of the invention as described above, in the signal processing unit 12, the first signal process is performed with respect to the audio data Sin with 2ch. However, a larger number of channels may be adopted. For example, in the case of 3ch including Cch, radiated sound that corresponds to the Cch may be output.

Figure 11:
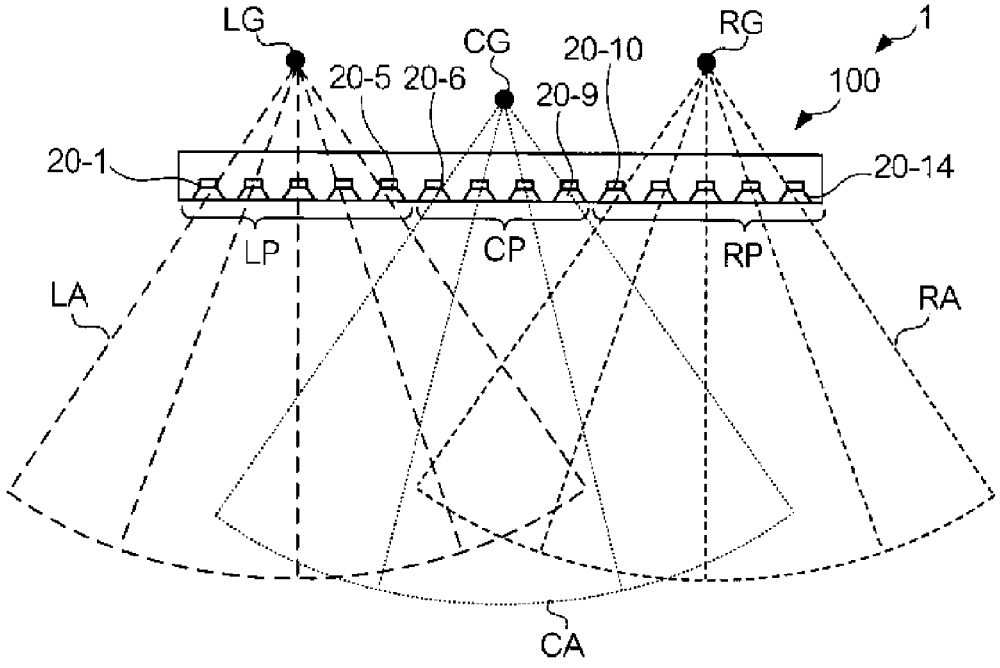
FIG. 11 is a diagram illustrating a reaching range of radiated sound and virtual focus positions according to a modified example 6 of the invention.

FIG. 11 is a diagram illustrating the reaching range of the radiated sound and the virtual focus position according to a modified example 6 of the invention. As illustrated in FIG. 11, in this example, Cch front surface area CP exists in addition to the Lch front surface area LP and the Rch front surface area RP. The Lch front surface area LP is an area that includes the speaker units 20-1, 20-2, . . . , and 20-5, the Cch front surface area CP is an area that includes the speaker units 20-6, 20-7, . . . , and 20-9, and the Rch front surface area RP is an area that includes the speaker units 20-10, 20-11, . . . , and 20-14.

The audio data C that corresponds to Cch is controlled by the control unit 3 so that it is input to the equalizer unit 11-C and is output to the signal processing unit 12-C. In a progress processing unit 12-C, the Cch virtual focus CG, in the same manner as other virtual focuses, is set by the control unit 3 so that the Cch virtual focus CG is on the rear side of the housing 100 in the center portion of the Cch front surface area CP. By doing this, the radiated sound that corresponds to the Cch is output to the Cch radiation area CA.

In an example illustrated in FIG. 11, the Cch virtual focus CG exists in a position that is closer to the front face 100F than the Lch virtual focus LG and the Rch virtual focus RG. This is to make the spreading angle of the Cch radiation area CA coincide with the spreading angles of the Lch radiation area LA and the Rch radiation area RA although the number of speaker units that output the sound based on the audio data C is small. By making the spreading angles coincide with each other, the transfer characteristics of the sounds from the sound sources located at three virtual focuses to the listener become similar to each other, and thus the listening area without incongruity is widened to remarkably increase the effect of the invention. If the spreading angles do not need to coincide with each other, the relationship between the position of the Cch virtual focus CG and the positions of the Lch virtual focus LG and the Rch virtual focus RG is not limited to the above-described relationship.

Modified Example 7

In the above-described embodiment of the invention, the signal processing group 12 performs the second signal process in the case where the input audio data Sin corresponds to 5ch. However, the first signal process may be performed with respect to a part of the channels. For example, with respect to the FL ch and the FR ch, the first signal process may be performed. That is, the speaker device 1 may be such configured that the speaker array unit 2 outputs the radiated sound and the sound beam in the same period.

Figure 12:
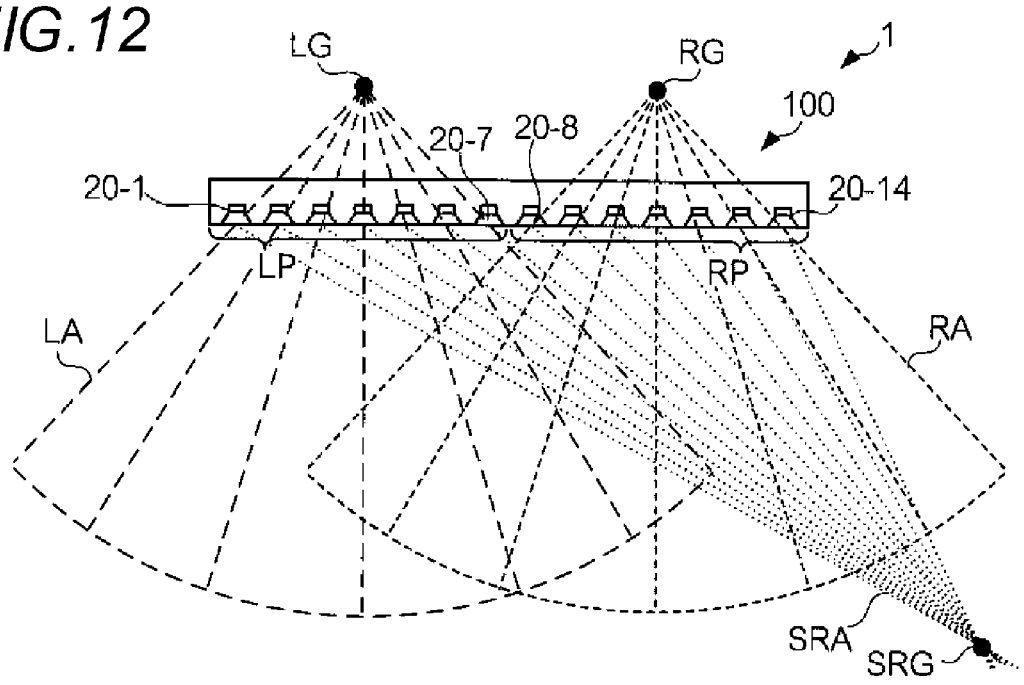
FIG. 12 is a diagram illustrating a reaching range of radiated sound and virtual focus positions according to a modified example 7 of the invention.

FIG. 12 is a diagram illustrating the reaching range of the radiated sound and the virtual focus position according to a modified example 7 of the invention. As illustrated in FIG. 12, in this example, the signal processing unit 12 performs the first signal process with respect to the C ch, FL ch (Lch), and FR ch (Rch), and performs the second signal process with respect to the SL ch and SR ch. In FIG. 12, the radiated sounds of L ch and R ch and the sound beam of SR ch are described, but other channel sounds are omitted. As illustrated in FIG. 12, the sound based on the audio data SR is output from the speaker units 20-1, 20-2, . . . , and 20-14 as the sound beam. This SR ch sound beam is output to the area SRA, and has a focus SRG. The direction and the focus position of this sound beam are controlled by the control unit so that the sound beam is reflected by a wall surface of a room and reaches the listener.

Modified Example 8

In the above-described embodiment of the invention, the plurality of speaker units 20-1, 20-2, . . . , and 20-14, which constitute the speaker array unit 2 are arranged to stand in a row. However, the speaker units may be arranged to stand in two or more rows.

Figure 13:
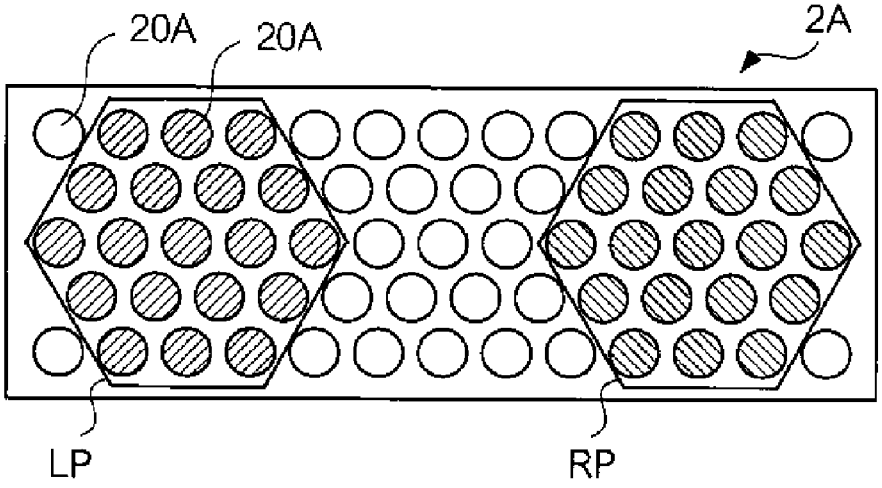
FIG. 13 is a diagram illustrating an arrangement shape of speaker units and sound radiation according to a modified example 8 of the invention.

FIG. 13 is a diagram illustrating the arrangement shape of the speaker units and sound output portions according to a modified example 8 of the invention. As illustrated in FIG. 13, the speaker array unit 2A has speaker units 20A arranged to stand in five rows in a surface shape. In the case where the speaker units are installed as described above, the shape of the L ch front surface area LP and the R ch front surface area RP may be a polygon (in this example, a hexagon) or a circle. The center portion of the L ch front surface area LP having the above-described shape substantially becomes a portion of center of gravity, and the L ch virtual focus LG may be installed on the rear side of the housing of this portion. The R ch is the same.

In the above-described embodiment of the invention, in the case where the input audio data Sin corresponds to 5ch, the signal processing unit 12 performs the second signal process. However, the first signal process may be performed through an appropriate reduction of the number of channels through a mixing process, and the first signal process may be performed with respect to a part of the channels, while the second signal process may be performed with respect to other channels.

On the contrary, in the case where the input audio data Sin corresponds to 2ch, the signal processing unit 12 may perform the second signal process through an appropriate increase of the number of channels through channel extension. Even in this case, the first signal process may be performed with respect to a part of the channels.

Modified Example 10

In the above-described embodiment of the invention, the control program may be provided in a state where it is stored in a computer-readable recording medium, such as a magnetic recording medium (magnetic tape, magnetic disk, and the like), an optical recording medium (optical disk and the like), an optomagnetic recording medium, a semiconductor memory, and the like. Also, the speaker device 1 may download the control program through a network.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2010-205418 filed on Sep. 14, 2010, the contents of which are incorporated herein by reference.

What is claimed is:

1. A speaker device comprising:

a signal processing section that performs a signal process with respect to audio signals of a plurality of channels; and a speaker array having a plurality of speaker units, including a first speaker units group having first speaker units, among the plurality of speaker units, and a second speaker units group having a second speaker units, among the plurality of speaker units, for outputting sounds according to the audio signals of the plurality of channels, the second speaker units group being different from the first speaker units group, wherein the signal processing section performs a first signal process in which:

sound based on an audio signal of a first channel, among the plurality of channels, is set so as to be output only from the first speaker units group and a first virtual focus that is a virtual output position of the sound based on the audio signal of the first channel is set to an opposite side of the speaker array, which is opposite to a sound output direction of the first speaker units group with respect to the speaker array;

sound based on an audio signal of a second channel, which is different from the first channel, among the plurality of channels, is set so as to be output only from the second speaker units group and a second virtual focus that is a virtual output position of the sound based on the audio signal of the second channel is set to the opposite side of the speaker array, which is opposite to a sound output direction of the second speaker units group with respect to the speaker array;

the first virtual focus is set to the opposite side of the speaker array that is separated in a normal direction normal to an arrangement direction of the speaker array from a center portion of the first speaker units group, and the second virtual focus is set to the opposite side of the speaker array that is separated in the normal direction from a center portion of the second speaker units group; and the audio signals of the first and second channel are output from the respective first and second speaker units groups as radiated sound, wherein the number of each of the first and second speaker units is less than a total number of the plurality of speaker units of the speaker array to limit overlap of sound emission areas of the first and second channels, and wherein the signal processing section processes the first signal process so that:

the audio signal of the first channel is output only from the first speaker units group as radiated sound that is symmetrically distributed with respect to a first imaginary line intersecting the first virtual focus and extending in a direction perpendicular to an arrangement direction of the first speaker units of the first speaker units group; and the audio signal of the second channel is output only from the second speaker units group as radiated sound that is symmetrically distributed with respect to a second imaginary line intersecting the second virtual focus and extending in a direction perpendicular to an arrangement direction of the second speaker units of the second speaker units group.

2. The speaker device according to claim 1, wherein each of the first and second speaker units are arranged on a front face of a housing.

3. The speaker device according to claim 1, wherein the signal processing section performs a second signal process in which a directivity is applied to the sound output from all of the first and second speaker units.

4. The speaker device according to claim 1, wherein at least one of the first speaker units is closest to one end side in an arrangement direction of the speaker array, and at least one of the second speaker units is closest to the opposite end side in the arrangement direction of the speaker array.

5. The speaker device according to claim 1, wherein in the first signal process, a distance between the first virtual focus and the second virtual focus is substantially same as a distance between the center portion of the first speaker units group and the center portion of the second speaker units group.

6. The speaker device according to claim 1, wherein the first speaker units group and the second speaker units group include no common speaker unit to be commonly used.

7. The speaker device according to claim 3, wherein the signal processing section performs the first signal process when the audio signals of the first and second channels are supplied and performs the second signal process when an audio signal of at least one additional channel, among the plurality of channels, other than the first and second channels is supplied.

8. The speaker device according to claim 3, wherein the signal processing section performs the first signal process and the second signal process at the same time when the audio signals of the first and second channels and at least two additional channels besides the first and second channels, among the plurality of channels, are supplied.

9. The speaker device according to claim 1, wherein the first speaker units group and the second speaker units group include a common speaker unit to be commonly used.

10. The speaker device according to claim 1, wherein a speaker unit, among the plurality of speaker units, not included in the first and second speaker units is not used for outputting the sounds according to the audio signals of the plurality of channels.

11. The speaker device according to claim 1, wherein:

the speaker array includes a third speaker units group having third speaker units other than the first and second speaker units, and in the first signal process, sound based on an audio signal of a third channel, which is different from the first and second channels, is set to be output from the third speaker units group and a third virtual focus that is a virtual output position of the sound based on the audio signal of the third channel is set to the opposite side of the speaker array, which is opposite to a sound output direction of the third speaker units group with respect to the speaker array.

12. The speaker device according to claim 1, wherein the signal processing section reduces the number of channels by mixing the channels when the audio signals of the plurality of channels are supplied.

13. The speaker device according to claim 1, wherein the plurality of speaker units of the speaker array are arranged in rows.

14. The speaker device according to claim 13, wherein the first speaker units of the first speaker units group and the second speaker units of the second speaker units group each are arranged to form a polygonal shape region viewed from a sound output direction of the speaker array.

15. The speaker device according to claim 13, wherein the first speaker units of the first speaker units group and the second speaker units of the second speaker units group each are arranged to form a circular shape region viewed from a sound output direction of the speaker array.

* * * * *